United States Patent [19]

Herbert et al.

[11] Patent Number: 5,069,758

[45] Date of Patent: Dec. 3, 1991

[54] PROCESS FOR SUPPRESSING THE PLYWOOD EFFECT IN PHOTOSENSITIVE IMAGING MEMBERS

[75] Inventors: William G. Herbert, Williamson; John R. Andrews, Fairport; Clifford H. Griffiths, Pittsford, all of N.Y.

[73] Assignee: Xerox Corporation, Stamford, Conn.

[21] Appl. No.: 646,117

[22] Filed: Jan. 28, 1991

[51] Int. Cl.[5] ..... C25D 1/02

[52] U.S. Cl. ..... 205/73

[58] Field of Search ..... 204/4, 9

[56] References Cited

U.S. PATENT DOCUMENTS 3,844,906 10/1974 Bailey et al. ..... 204/9

4,618,552 10/1986 Tanaka et al. ..... 430/60

*Primary Examiner*—T. M. Tufariello

[57] ABSTRACT

A layered photosensitive imaging member is modified to reduce the effects of interference within the member caused by reflections from coherent light incident on a base ground plane. The modification described is to form the ground plane surface with a rough surface morphology by an electroforming process which leaves the surface with a matte-like finish. Light reflected from the ground plane formed with the matte finish is diffused through the bulk of the photosensitive layer breaking up the interference fringe patterns which are otherwise later manifested as a plywood pattern on output prints made from the exposed sensitive medium.

6 Claims, 7 Drawing Sheets

PROCESS FOR SUPPRESSING THE PLYWOOD EFFECT IN PHOTOSENSITIVE IMAGING MEMBERS

BACKGROUND AND MATERIAL DISCLOSURE STATEMENT

The present invention relates to an imaging system using coherent light radiation to expose a layered member in an image configuration and, more particularly, to a method for modifying an imaging member to suppress optical interference occurring within said photosensitive member which results in a defect that resembles the grain in a sheet of plywood in output prints derived from said exposed photosensitive member when the exposure is a uniform, intermediate-density gray.

There are numerous applications in the electrophotographic art wherein a coherent beam of radiation, typically from a helium-neon or diode laser is modulated by an input image data signal. The modulated beam is directed (scanned) across the surface of a photosensitive medium. The medium can be, for example, a photoreceptor drum or belt in a xerographic printer, a photosensor CCD array, or a photosensitive film. Certain classes of photosensitive medium which can be characterized as "layered photoreceptors" have at least a partially transparent photosensitive layer overlying a conductive ground plane. A problem inherent in using these layered photoreceptors, depending upon the physical characteristics, is the creation of two dominant reflections of the incident coherent light on the surface of the photoreceptor; e.g., a first reflection from the top surface and a second reflection from the bottom surface of the relatively opaque conductive ground plane. This condition is shown in FIG. 1; coherent beams 1 and 2 are incident on a layered photoreceptor 6 comprising a charge transport layer 7, charge generator layer 8, and a ground plane 9. The two dominant reflections are: from the top surface of layer 7, and from the top surface of ground plane 9. Depending on the optical path difference as determined by the thickness and index of refraction of layer 7, beams 1 and 2 can interfere constructively or destructively when they combine to form beam 3. When the additional optical path traveled by beam 1 (dashed rays) is an integer multiple of the wavelength of the light, constructive interference occurs, more light is reflected from the top of charge transport layer 7 and, hence, less light is absorbed by charge generator layer 8. Conversely, a path difference producing destructive interference means less light is lost out of the layer and more absorption occurs within the charge generator layer 8. The difference in absorption in the charge generator layer 8, typically due to layer thickness variations within the charge transport layer 7, is equivalent to a spatial variation in exposure on the surface. This spatial exposure variation present in the image formed on the photoreceptor becomes manifest in the output copy derived from the exposed photoreceptor. FIG. 2 shows the areas of spatial exposure variation (at 25×) within a photoreceptor of the type shown in FIG. 1 when illuminated by a He-Ne laser with an output wavelength of 633 nm. The pattern of light and dark interference fringes look like the grains on a sheet of plywood. Hence the term "plywood effect" is generically applied to this problem.

One method of compensating for the plywood effect known to the prior art is to increase the thickness of and, hence, the absorption of the light by the charge generator layer. For most systems, this leads to unacceptable tradeoffs; for example, for a layered organic photoreceptor, an increase in dark decay characteristics and electrical cyclic instability may occur. Another method, disclosed in U.S. Pat. No. 4,618,552 is to use a photoconductive imaging member in which the ground plane, or an opaque conductive layer formed above or below the ground plane, is formed with a rough surface morphology to diffusely reflect the light.

According to the present invention, the interference effect is eliminated by breaking up the coherence of reflections from the surface of the ground plane by a novel process which, in a preferred embodiment, includes forming the photoreceptor substrate (ground plane) by an electroforming process which imparts to the ground plane a matte-like finish. More particularly the present invention related to a process for forming a photosensitive imaging member comprising the steps of forming a ground plane with a matte finish by an electroforming process, and overlying said ground plane with at least a charge transport layer and charge generating layer.

Disclosures which are believed to be relevant to the present invention:

Application Ser. No. 07/546,214, filed on June 24, 1990, discloses a method for merging scanned beams from 2 or more diodes at a photoreceptor surface. The beams are at different wavelengths producing an exposure variation pattern at the surface which compensates for the plywood exposure.

Application Ser. No. 07/541,655, filed on June 21, 1990, discloses an imaging member with a ground plane formed on an underlying substrate whose surface has been roughened. The ground plane surface has a conforming roughness and presents a diffused reflecting surface to eliminate direct reflection causing the plywood exposure.

Application Ser. No. 07/546,990 discloses various processes for forming a ground plane with a rough surface morphology.

Application Ser. No. 07/552,200 discloses an imaging member having a low reflection layer formed on the ground plane. The low reflection layer reduces the secondary reflections from the ground plane contributing to the plywood effect.

Application Ser. No. 07/523,639, filed on May 15, 1990, discloses an imaging member which has a ground plane formed of a low reflection material. The ground plane serves to suppress the interference fringes caused by the otherwise strong reflections from a high reflecting ground plane.

DESCRIPTION OF THE INVENTION

Figure 1:
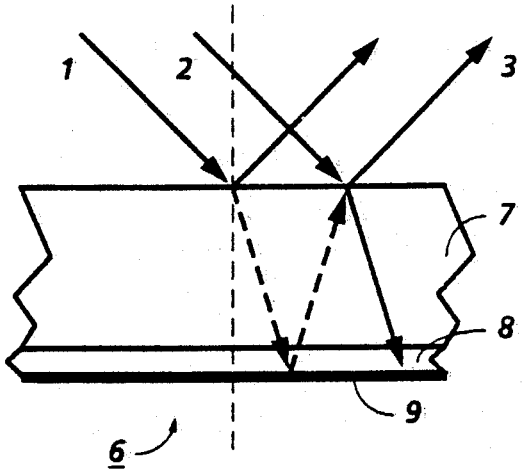
FIG. 1 PRIOR ART
FIG. 1 shows coherent light incident upon a prior art layered photosensitive medium leading to reflections internal to the medium.
Figure 2:
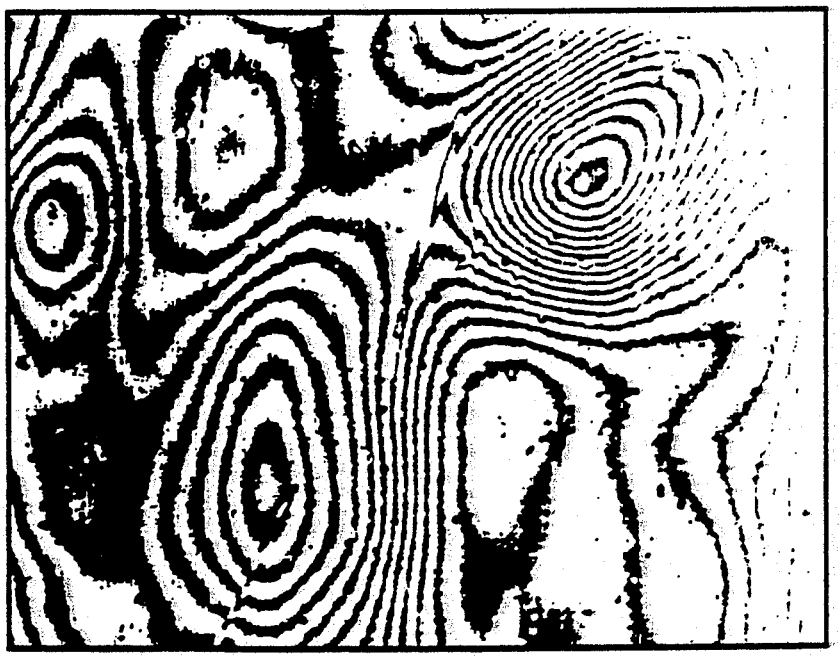
FIG. 2 shows a spatial exposure variation plywood pattern in the exposed photosensitive medium of FIG. 1 produced when the spatial variation in the absorption within the photosensitive member occurs due to an interference effect.
Figure 3:
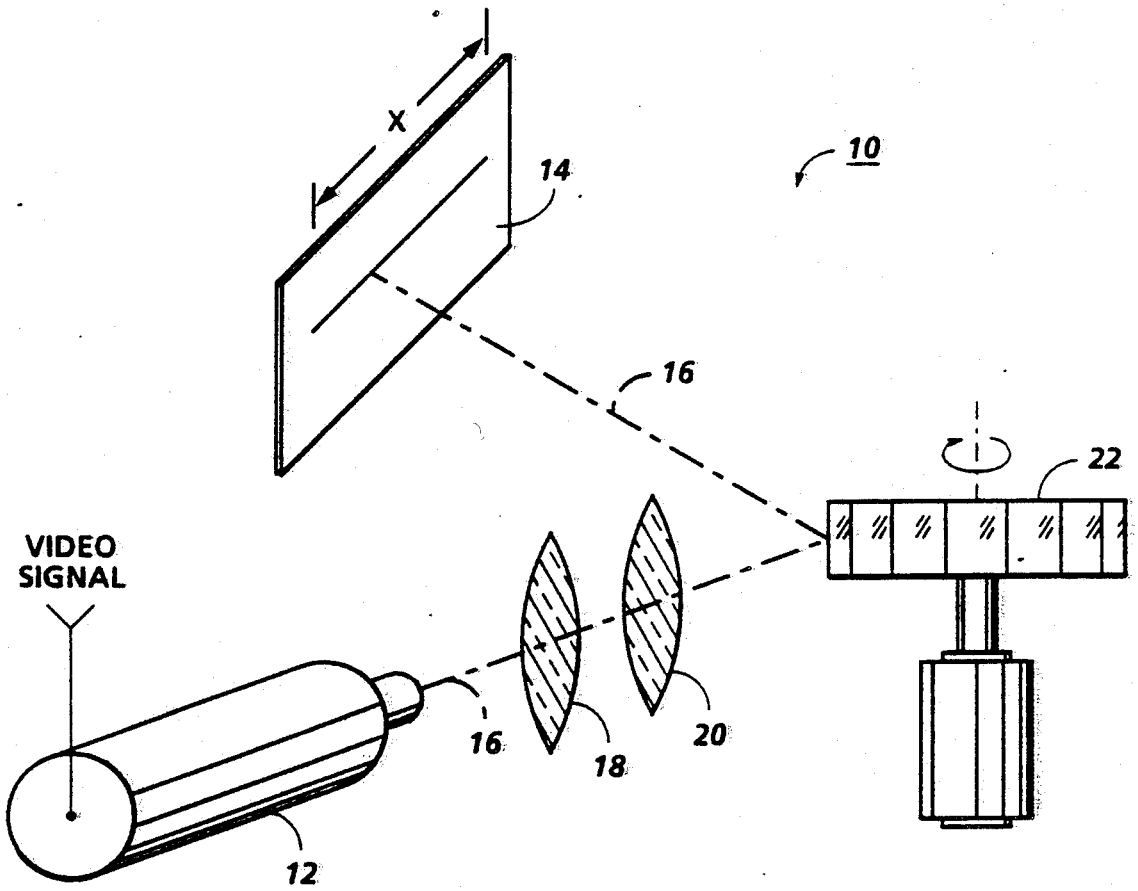
FIG. 3 is a schematic representation of an optical system incorporating a coherent light source to scan a light beam across a photoreceptor modified to reduce the interference effect according to the present invention.

FIG. 3 shows an imaging system 10 wherein a laser 12 produces a coherent output which is scanned across photoreceptor 14. Laser 12 is, for this embodiment, a helium neon laser with a characteristic wavelength of 0.63 micrometer, but may be, for example, an Al Ga As Laser diode with a characteristic wavelength of 0.78 micrometer. In response to video signal information representing the information to be printed or copied, the laser is driven so as to provide a modulated light output beam 16. Flat field collector and objective lens 18 and 20, respectively, are positioned in the optical path between laser 12 and light beam reflecting scanning device 22. In a preferred embodiment, device 22 is a multi-faceted mirror polygon driven by motor 23, as shown. Flat field collector lens 18 collimates the diverging light beam 16 and field objective lens 20 causes the collected beam to be focused onto photoreceptor 14 after reflection from polygon 22. Photoreceptor 14, in a preferred embodiment, is a layered photoreceptor shown in partial cross-section in FIG. 4.

Figure 4:
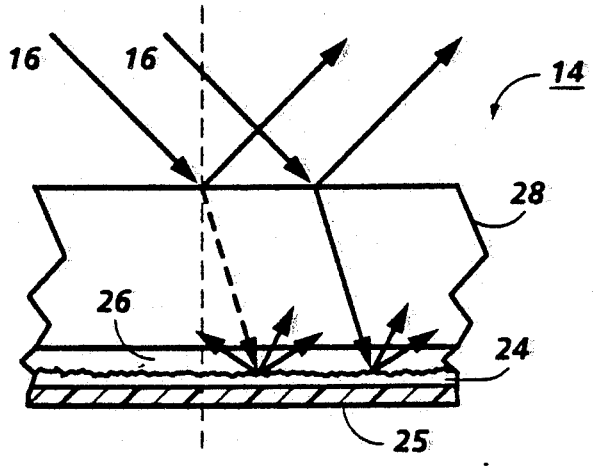
FIG. 4 is a partial cross-sectional view of the photoreceptor of FIG. 3 showing a ground plane with a matte-like surface formed by a process according to the invention.

Referring to FIG. 4, photoreceptor 14 is a layered photoreceptor which includes a conductive ground plane 24 having a matte finish and formed by an electroforming process of the present invention. The photoreceptor also includes a dielectric substrate 25, (typically polyethylene Terephthalate [PET]), a charge generating layer 26, and a semitransparent charge transport layer 28. A blocking layer (not shown) is provided at the interface of ground plane 24 and charge generating layer 26 to trap charge carriers. A photoreceptor of this type (with a conventional ground plane 24) is disclosed in U.S. Pat. No. 4,588,667 whose contents are hereby incorporated by reference. The ground plane 24 has a matte-like surface causing the light rays 16 penetrating through layers 28 and 26 to be diffusely scattered upon reflection from the surface of ground plane 24. The diffuse scatter creates a phase randomization of the reflected light and therefore prevents the interference changes related to the transport layer thickness. A "matte-like" finish will be defined in more detail below, but generally defines a surface having a smooth enough finish to allow the overlying photosensitive layers to properly adhere, yet having sufficient roughness to diffuse the incident light to eliminate the plywood effect and also to have a characteristic gray or cloudy color.

Ground plane 24 is formed by an electroforming process in which a conventional electroforming techniques such as disclosed in U.S. Pat. No. 3,844,906, (contents hereby incorporated by reference) is modified so as to control the forming conditions to create a surface having a 0.1 to 1.5 micro meter RMS surface, and a dull (cloudy, gray or milky) finish. In a preferred embodiment, ground plane 24 is an electroconductive (nickel) flexible seamless belt. The belt is electrodeposited on a cylindrically shaped form or mandrel which is suspended in an electrolytic bath (nickel sulfamate solution). A dc potential is applied between the rotating mandrel cathode and the donor metallic nickel anode for a sufficient period of time to effect electrodeposition of nickel on the mandrel to a predetermined thickness (0.0010 to 0.010 inch are typical thicknesses). Upon completion of the electroforming process, the mandrel and the nickel belt formed thereon are transferred to a cooling zone whereby the belt, which exhibits a different coefficient of thermal expansion than the mandrel, can be readily separated from the mandrel. The surface roughness of the belt is controlled to provide a surface smoothness (or roughness) of preferably 0.5–20/0 $\mu$ inch RMS, and the color is controlled to produce a preferably milky-white finish. The photosensitive layer (charge generating layer 26 and charge transport layer 28) is then deposited on ground plane 24 substrate 25 using conventional techniques known in the art. The photoreceptor 14, when used for example, in the ROS system shown in FIG. 3, exhibits virtually none of the spectral exposure variations which would otherwise have been caused by reflection from the ground plane.

It has been found that the above combination of smooth and dull ground plane can be achieved by controlling one or more of the bath constituents and/or operating parameters used during the electroforming process. Five examples are given below of electroforming processes which yield a ground plane substrate having the above-defined smooth and dull surface. The operating parameter differences between these examples are then explored to characterize their effect on the ground plane finish so as to exhibit their relative importance in controlling the electroforming process. Finally, preferred operating parameter ranges are set forth to optimize the electroforming process.

EXAMPLE 1

Major Electrolyte Constituents

Nickel Sulfamate—as $Ni^{+2}$, 11.5 oz/gal. (86.25 g/L)
Chloride—as $NiCl_2.6H_2O$, 2 oz/gal. (15 g/L)
Boric Acid—5.0–5.4 oz/gal. (37.5–40.5 g/L)
pH—3.95–4.05 at 23° C.
Surface Tension—at 136° F., 32–37 d/cm using Sodium Lauryl Sulfate (about 0.00525 g/l).
Saccharin—15 mg/L, as Sodium Benzosulfimide dihydrate.

Impurities

Azodisulfonate—6–7 mg/L.
Copper—5 mg/L.
Iron—25 mg/L.
MBSA—(2-Methyl Benzene Sulfonamide)—6–8 mg/L.
Sodium—0.1 gm/L.
Sulfate—0.5 g/L.

Operating Parameters

Agitation Rate—5 Linear ft/sec cathode rotation and 15-20 L/min solution flow to the 200 L cell.

Cathode (Mandrel)—Current Density, 225 ASF (amps per square foot).

Ramp Rise—0 to operating amps in 60 sec.±5 sec.

Plating Temperature at Equilibrium—135 and 145° F.

Anode—Sulfur Depolarized Nickel.

Anode to Cathode Ratio—1.5:1.

Mandrel—8 inch diameter Chromium plated Aluminum-12 micro inch RMS.

EXAMPLE 2

Major Electrolyte Constituents:

Nickel Sulfamate—as $Ni^{+2}$, 11.5 oz/gal. (86.25 g/L)

Chloride—as $NiCl_2.6H_2O$, 2.5 oz/gal. (18.75 g/L)

Boric Acid—5.0-5.4 oz/gal. (37.5-40.5 g/L)

pH—3.95-4.05 at 23° C.

Surface Tension—at 60° C., 32-37 d/cm using Sodium Lauryl Sulfate (about 0.00525 g/l).

Saccharin—30 mg/L, as Sodium Benzosulfimide dihydrate

Impurities:

Azodisulfonate—5-7 mg/L.

Cobalt—0.09 g/L.

Copper—5 mg/L.

Iron—25 mg/L.

MBSA—(2-Methyl Benzene Sulfonamide)—5-6 mg/L.

Sodium—0.1 gm/L.

Sulfate—0.5 g/L.

Operating Parameters:

Agitation Rate—150 Linear cm/sec cathode rotation and 100 L/min solution flow to the 400 L cell.

Cathode (Mandrel)—Current Density, 24 ASD (amperes per square decimeter).

Anode—Carbonyl Nickel.

Anode to Cathode Ratio—1.5:1.

Mandrel—20 cm diameter Chromium plated Aluminum—5 micro inch RMS.

| | 1st RUN | 2nd RUN | 3rd RUN | 4th RUN | 5th RUN | 6th RUN | 7th RUN | 8th RUN |
|---|---|---|---|---|---|---|---|---|
| TEMPERATURE °C. | 53 | 54 | 55 | 56 | 57 | 58 | 59 | 60 |
| DEPOSIT THICKNESS | 0.0762 mm for all runs. | | | | | | | |
| RAMP RISE Sec | 100 | 110 | 110 | 120 | 120 | 135 | 143 | 150 |
| ROUGHNESS μ inch RMS | 5 | 4 | 5 | 4 | 5 | 5 | 5 | 5 |

EXAMPLE 3

Major Electrolyte Constituents

Nickel Sulfamate—as $Ni^{+2}$, 9.5 oz/gal. (71.25 g/L)

Chloride—as $NiCl_2.6H_2O$, 2.5 oz/gal. (18.75 g/L)

Boric Acid—5.0-5.4 oz/gal. (37.5-40.5 g/L)

pH—3.95-4.05 at 23° C.

Surface Tension—at 60° C., 32-37 d/cm using Sodium Lauryl Sulfate (about 0.00525 g/l).

Saccharin—30 mg/L, as Sodium Benzosulfimide dihydrate.

Impurities

Azodisulfonate—5-7 mg/L.

Cobalt—0.09 g/L.

Copper—5 mg/L.

Iron—25 mg/L.

MBSA—(2-Methyl Benzene Sulfonamide)—5-6 mg/L.

Sodium—0.1 gm/L.

Sulfate—0.5 g/L.

Operating Parameters

Agitation Rate—150 Linear cm/sec cathode rotation and 100 L/min solution flow to the 400 L cell.

Cathode (Mandrel)—Current Density, 24 ASD (amperes per square decimeter).

Anode—Carbonyl Nickel.

Anode to Cathode Ratio—1.5:1.

Mandrel—20 cm diameter Chromium plated Aluminum—5 micro inch RMS.

EXAMPLE 4

Major Electrolyte Constituents

Nickel Sulfamate—as $Ni^{+2}$, 8 oz/gal. (60 g/L).

Chloride—as $NiCl_2.6H_2O$, 2 oz/gal. (15 g/L).

Boric Acid—5.0-5.4 oz/gal. (37.5-40.5 g/L).

pH—3.95-4.05 at 23° C.

Surface Tension—at 60° C., 32-37 d/cm using Sodium Lauryl Sulfate (about 0.00525 g/l).

Saccharin—20 mg/L, as Sodium Benzosulfimide dihydrate.

Leveler—14 mg/L, as 2-butyne 1-4 diol.

Impurities

Azodisulfonate—5-7 mg/L.

Cobalt—0.09 g/L.

Copper—5 mg/L.

Iron—25 mg/L.

MBSA—(2-Methyl Benzene Sulfonamide)—4-6 mg/L.

Sodium—0.1 gm/L.

Sulfate—0.5 g/L.

Operating Parameters

Agitation Rate—150 Linear cm/sec cathode rotation and 100 L/min solution flow to the 400 L cell.

| | 1st RUN | 2nd RUN | 3rd RUN | 4th RUN | 5th RUN | 6th RUN | 7th RUN | 8th RUN |
|---|---|---|---|---|---|---|---|---|
| TEMPERATURE °C. | 53 | 54 | 55 | 56 | 57 | 58 | 59 | 60 |
| DEPOSIT THICKNESS | 0.0762 mm for all runs. | | | | | | | |
| RAMP RISE Sec | 100 | 110 | 110 | 120 | 120 | 135 | 143 | 150 |
| ROUGHNESS μ inch RMS | 15 | 14 | 15 | 14 | 15 | 15 | 15 | 15 |

Cathode (Mandrel)—Current Density, 20 ASD (amperes per square decimeter).

Anode—Carbonyl Nickel.

Anode to Cathode Ratio—1.5:1.

Mandrel—20 cm diameter Chromium plated Aluminium—0.8 micro inch RMS.

thoroughly understood so that they can be simultaneously controlled during the electroforming process. Each operating parameter is considered separately below.

MANDREL FINISH

| | 1st RUN | 2nd RUN | 3rd RUN | 4th RUN | 5th RUN | 6th RUN | 7th RUN | 8th RUN |
|---|---|---|---|---|---|---|---|---|
| TEMPERATURE °C. | 53 | 54 | 55 | 56 | 57 | 58 | 59 | 60 |
| DEPOSIT THICKNESS | 0.0762 mm for all runs. | | | | | | | |
| RAMP RISE Sec | 100 | 110 | 110 | 120 | 120 | 135 | 143 | 150 |
| ROUGHNESS μ inch RMS | 0.5 | 0.4 | 0.6 | 0.4 | 0.6 | 0.5 | 0.4 | 0.5 |

EXAMPLE 5

Major Electrolyte Constituents

Nickel Sulfamate—as $Ni^{+2}$, 10.0–10.5 oz/gal. (75–78.75 g/L).

Chloride—as $NiCl_2.6H_2O$, 1.5–2.5 oz/gal. (11.25–18.75 g/L).

Boric Acid—5.0–5.4 oz/gal. (37.5–40.5 g/L).

pH—3.95–4.15 at 23° C.

Surface Tension—at 136° F., using SLS 32–37 dynes/cm using Sodium Lauryl Sulfate.

Saccharin—0–25 mg/L, as Sodium Benzosulfimide dihydrate.

Impurities

Aluminum—0–20 mg/L maximum.

Ammonia—0–400 mg/L maximum.

Arsenic—0–10 mg/L maximum.

Azodisulfonate—0–50 mg/L maximum.

Cadmium—0–10 mg/L maximum.

Calcium—0–20 mg/L maximum.

Hexavalent Chromium—4 mg/L maximum.

Copper—0–5 mg/L maximum.

Iron—0–250 mg/L maximum.

Lead—0–8 mg/L maximum.

MBSA—(2-Methyl Benzene Sulfonamide)—0–20 mg/L maximum.

Nitrate—0–10 mg/L maximum.

Organic—Depends on the type, however, all known types need to be minimized.

Phosphates—0–10 mg/L maximum.

Silicates—0–10 mg/L maximum.

Sodium—0–0.5 gm/L maximum.

Sulfate—0–2.5 g/L maximum.

Zinc—0–5 mg/L maximum.

Operating Parameters

Agitation Rate—5 Linear ft/sec cathode rotation and 60±3 L/min solution flow to the 800 L cell.

Cathode (Mandrel)—Current Density, 150±25 ASF (amps per square foot).

Ramp Rinse—0 to operating amps in 60 sec.±1 sec.

Plating Temperature at Equilibrium—130°±3° F.

Anode—Carbonyl Nickel.

Anode to Cathode Ratio—1.5:1.

Mandrel—Chromium plated Aluminum—2–18 micro inch RMS.

Figure 5:
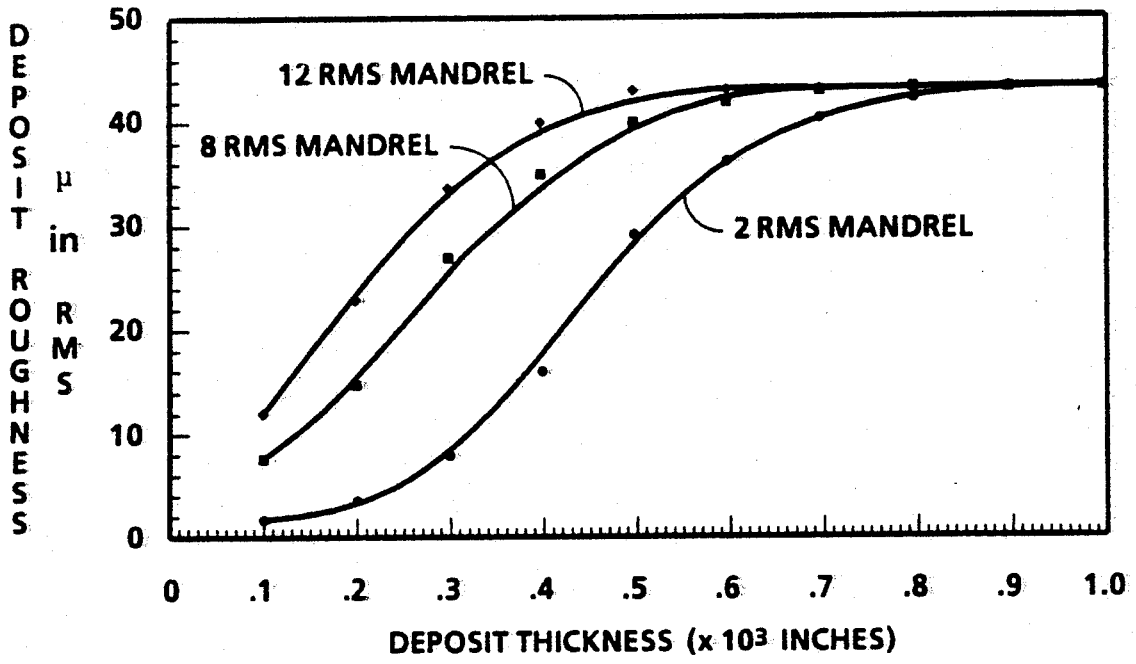
FIG. 5 is a plot of the thickness of the ground plane to the surface roughness for different mandrel surface finishes.

Upon consideration of the operating parameters of the five examples, it is seen that there are several parameters which are varied consistent with maintaining the desired smooth and dull finish on the ground plane. The impact of these parameters which include smoothness of the mandrel surface, nickel concentration, ramp current rise, current density and type of anode used must be FIG. 5 shows how the surface of the mandrel impacts the ground plane roughness vs. deposit thickness. The following electroforming conditions were used for each of the mandrel surfaces shown in FIG. 5 (2, 8, and 12 RMS).

Major Electrolyte Constituents

Nickel Sulfamate—as $Ni^{+2}$, 13.5 oz/gal. (101.25 g/L)

Chloride—as $NiCl_2.6H_2O$, 2 oz/gal. (15 g/L)

Boric Acid—5 oz/gal. (37.5 g/L)

pH—3.95–4.05 at 23° C.

Surface Tension—at 136° F.,·32–37 d/cm using Sodium Lauryl Sulfate (about 0.00525 g/l).

Saccharin—25–30 mg/L, as Sodium Benzosulfimide dihydrate

Impurities

Azodisulfonate—5–10 mg/L.

Copper—5 mg/L.

Iron—25 mg/L.

MBSA—(2-Methyl Benzene Sulfonamide)—5–10 mg/L.

Sodium—0.1 gm/L.

Sulfate—0.5 g/L.

Operating Parameters

Agitation Rate—5 Linear ft/sec solution flow over the cathode surface.

Cathode (Mandrel)—Current Density, 225 ASF (amps per square foot).

Ramp Rise—0 to operating amps in 2 sec±1 sec.

Anode—Sulfur Depolarized Nickel.

Anode to Cathode Ratio—1.2:1.

Mandrel—Chromium plated Aluminum—2, 8, and 12 micro inch RMS.

Temperature—60° C.

It is seen that the smoother the mandrel surface, the smoother the ground plane deposit roughness for a given deposit thickness, up to about 0.0009 inch (0.02286 mm) of deposit is obtained (at which all of the deposits have the same surface independent of the mandrel surface finish). The opposite is also true. That is, if the electrolyte used is producing a deposit which is smoother than the mandrel, the deposit will quickly become smoother than the mandrel. The surface roughness continues to increase at a rate of about 2μ inch RMS for each additional 0.005 inch of deposit. According to a first aspect of the present invention, utilization of mandrels having a surface roughness of between 2 and 8μ inch RMS are particularly useful to obtain the desired smooth ground plane matte finish or thicker deposition.

NICKEL CONCENTRATION

Figure 6:
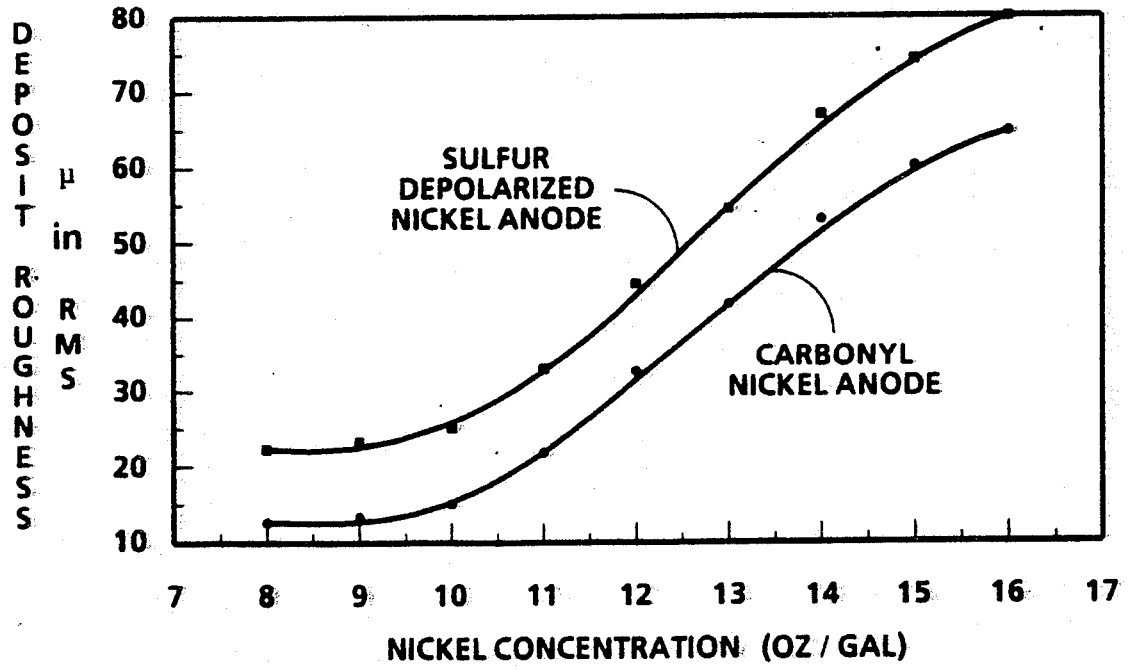
FIG. 6 is a plot of the effect of ground plane metal (nickel) concentration vs. ground plane roughness.

Nickel concentration has a dramatic effect on ground plane roughness as shown by the plot of FIG. 6 obtained using the parameters provided below.

Major Electrolyte Constituents

Nickel Sulfamate—as $Ni^{+2}$, 8-16 oz/gal. (60-120 g/L)
Chloride—as $NiCl_2.6H_2O$, 2 oz/gal. (15 g/L)
Boric Acid—5 oz/gal. (37.5 g/L)
pH—3.95-4.05 at 23° C.
Surface Tension—at 136° F., 32-37 d/cm using Sodium Lauryl Sulfate (about 0.00525 g/l).
Saccharin—25-30 mg/L, as Sodium Benzosulfimide dihydrate

Impurities

Azodisulfonate—5-10 mg/L.
Copper—5 mg/L.
Iron—25 mg/L.
MBSA—(2-Methyl Benzene Sulfonamide)—5-10 mg/L.
Sodium—0.1 gm/L.
Sulfate—0.5 g/L.

Operating Parameters

Agitation Rate—5 Linear ft/sec solution flow over the cathode surface.
Cathode (Mandrel)—Current Density, 225 ASF (amps per square foot).
Ramp Rise—0 to operating amps in 2 sec±1 sec.
Anode—Sulfur Depolarized Nickel and Carbonyl Nickel.
Anode to Cathode Ratio—1.2:1.
Deposit Thickness—0.0045 inches.
Mandrel—Chromium plated Aluminum—8 to 15 micro inch RMS.
Temperature—62° C.

Two types of anode material were used and are seen to behave similarly, except for a marked downward (smoother) shift using the carbonyl nickel anode material. But the significance of the plot is that a range of nickel concentrate from 8 to 10 oz/gal. is preferable since the deposit roughness shift is small for relatively large changes in nickel concentrations and a low concentration bath is less expensive to prepare.

RAMP CURRENT APPLICATION

Figure 7:
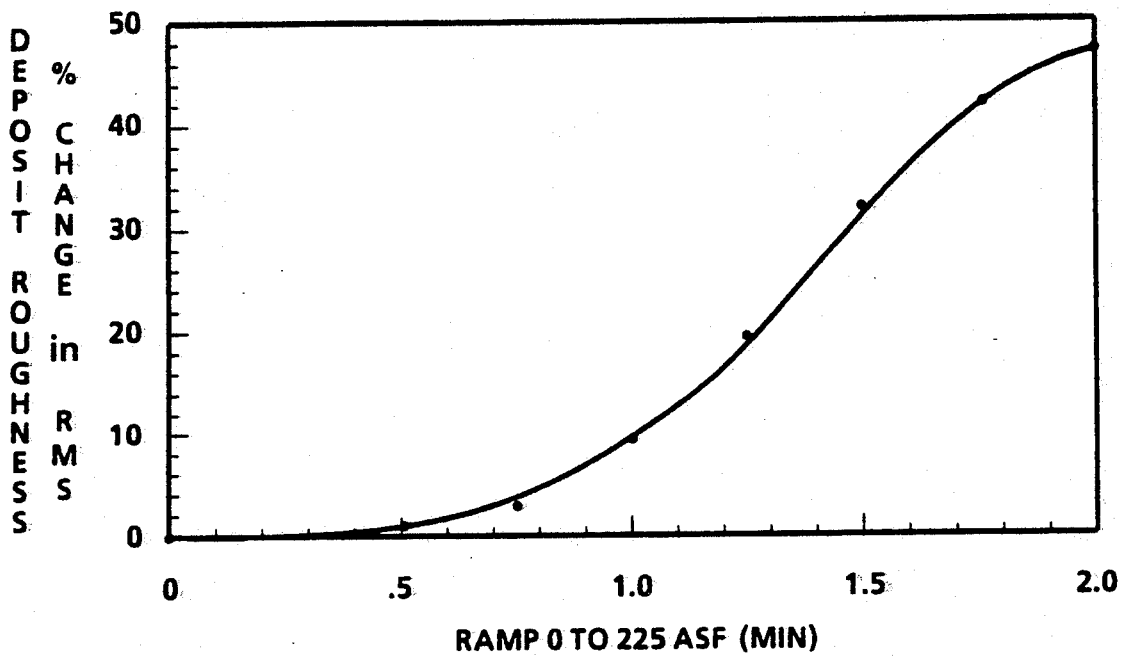
FIG. 7 is a plot showing the effect of ramp current application on ground plane roughness.

FIG. 7 shows that the time used to come to full current (ramp). can be used to compensate for surface roughness increases associated with electrolyte age; e.g., shortening of the ramp rise time results in peaking at the less lower roughness range. The following parameters were used to derive the FIG. 7 information:

Major Electrolyte Constituents

Nickel Sulfamate—as $Ni^{+2}$, 13 oz/gal. (97.5 g/L)
Chloride—as $NiCl_2.6H_2O$, 2 oz/gal. (15 g/L)
Boric Acid—5 oz/gal. (37.5 g/L)
pH—3.95-4.05 at 23° C.
Surface Tension—at 136° F., 32-37 d/cm using Sodium Lauryl Sulfate (about 0.00525 g/l).
Saccharin—25-30 mg/L, as Sodium Benzosulfimide dihydrate

Impurities

Azodisulfonate—5-10 mg/L.
Copper—5 mg/L.
Iron—25 mg/L.
MBSA—(2-Methyl Benzene Sulfonamide)—5-10 mg/L.
Sodium—0.1 gm/L.
Sulfate—0.5 g/L.

Operating Parameters

Agitation Rate—5 Linear ft/sec solution flow over the cathode surface.
Cathode (Mandrel)—Current Density, 225 ASF (amps per square foot).
Ramp Rise—0 to operating amps in 2 sec.±1 sec to 2 min±2 sec.
Anode—Sulfur Depolarized Nickel and Carbonyl Nickel.
Anode to Cathode Ratio—1.2:1.
Deposit Thickness—0.0045 inches.
Mandrel—Chromium plated Aluminum—8 to 15 micro inch RMS.
Temperature—62° C.

The impact of ramp current application appears to be independent of anode type as the above results were repeated using both SD and carbonyl nickel anodes. The effect is not independent of nickel concentration, however, as a one minute ramp produced no change in surface roughness using a 16 oz/gal. electrolyte but produced a 15% reduction in expected surface roughness at 11.5 oz./gal. and a 17.5% reduction in surface roughness at 10 oz./gal. The above data shows a 10% reduction at 13 oz./gal.

CURRENT DENSITY

Figure 8:
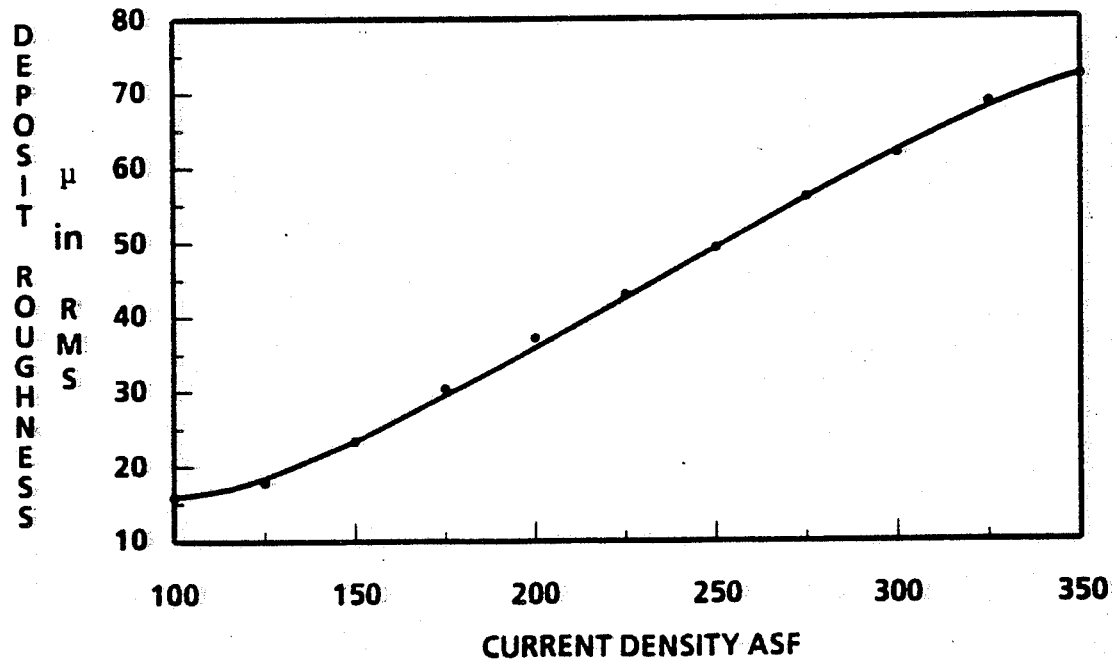
FIG. 8 is a plot showing the relationship of electroforming current density to ground plane roughness.

FIG. 8 shows the relationship of current density to deposit roughness obtained with the following example:

Major Electrolyte Constituents

Nickel Sulfamate—as $Ni^{+2}$, 13.5 oz/gal. (101.25 g/L)
Chloride—as $NiCl_2.6H_2O$, 2 oz/gal. (15 g/L)
Boric Acid—5. oz/gal. (37.5 g/L)
pH—3.95-4.05 at 23° C.
Surface Tension—at 136° F., 32-37 d/cm using Sodium Lauryl Sulfate (about 0.00525 g/l).
Saccharin—25-30 mg/L, as Sodium Benzosulfimide dihydrate

Impurities

Azodisulfonate—5-10 mg/L.
Copper—5 mg/L.
Iron—25 mg/L.
MBSA—(2-Methyl Benzene Sulfonamide)—5-10 mg/L.
Sodium—0.1 gm/L.
Sulfate—0.5 g/L.

Operating Parameters

Agitation Rate—5 Linear ft/sec solution flow over the cathode surface.
Cathode (Mandrel)—Current Density, 100 to 350 ASF (amps per square foot).
Ramp Rise—0 to operating amps in 2 sec±1 sec.
Anode—Sulfur Depolarized Nickel.
Anode to Cathode Ratio—1.2:1.
Deposit Thickness—0.0045 inches.
Mandrel—Chromium plated Aluminum—8 to 15 micro inch RMS.
Temperature—60° C.

The nearly linear relationship between current density and surface finish makes this parameter an important control for surface finish. This advantage is somewhat neutralized by the increase in deposition time required at lower current densities. Consequently, while easy to use and compatible with automation and programming current density is often kept as high as possible to maximize deposition rate. It is also important to note that if the current density is reduced to lower the surface roughness, the deposit will also have a higher internal compressive stress when the electrolyte contains diffusion controlled constituents that impact compressive stress.

ELECTROLYTE OPERATING TEMPERATURE - ANODE TYPE

Figure 9:
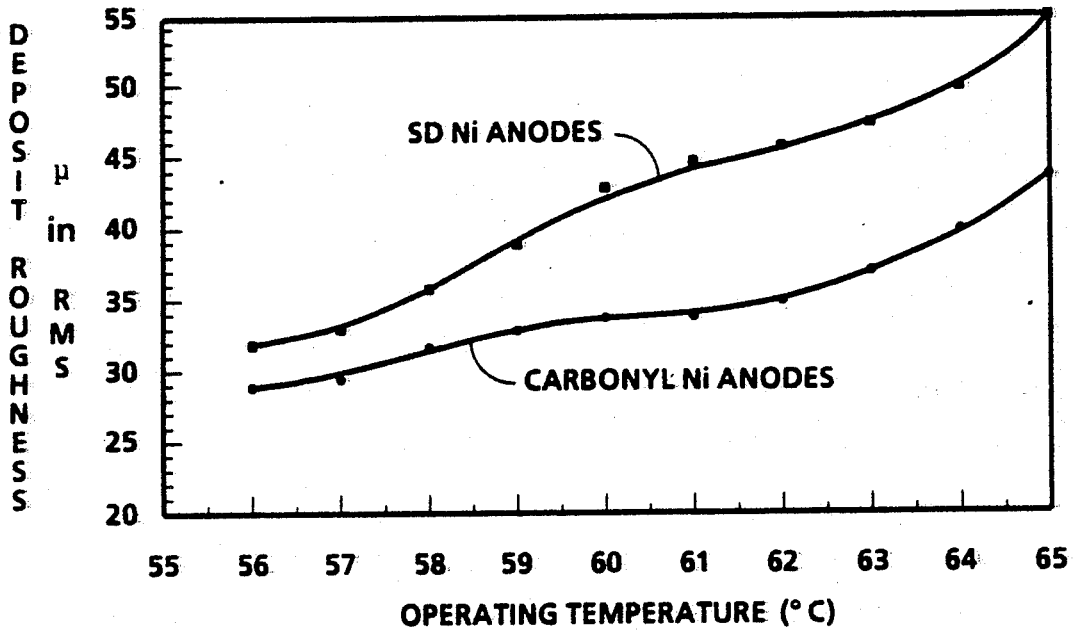
FIG. 9 is a plot showing the effect of operating temperatures on ground plane roughness with two different anodes.

FIG. 9 shows the effect of operating temperature using two types of anodes, on a deposit roughness obtained using the following example:

Major Electrolyte Constituents

Nickel Sulfamate—as $Ni^{+2}$, 12 oz/gal. (90 g/L)
Chloride—as $NiCl_2.6H_2O$, 2 oz/gal. (15 g/L)
Boric Acid—5 oz/gal. (37.5 g/L)
pH—3.95-4.05 at 23° C.
Surface Tension—at 136° F., 32-37 d/cm using Sodium Lauryl Sulfate (about 0.00525 g/l).
Saccharin—25-30 mg/L, as Sodium Benzosulfimide dihydrate

Impurities

Azodisulfonate—5-10 mg/L.
Copper—5 mg/L.
Iron—25 mg/L.
MBSA—(2-Methyl Benzene Sulfonamide)—5-10 mg/L.
Sodium—0.1 gm/L.
Sulfate—0.5 g/L.

Operating Parameters

Agitation Rate—5 Linear ft/sec solution flow over the cathode surface.
Cathode (Mandrel)—Current Density, 225 ASF (amps per square foot).
Ramp Rise—0 to operating amps in 2 sec±1 sec.
Anode—Sulfur Depolarized Nickel and Carbonyl Nickel.
Anode to Cathode Ratio—1.2:1.
Deposit Thickness—0.0045 inches.
Mandrel—Chromium plated Aluminum—8 to 15 micro inch RMS.
Temperature—55° to 65° C.

Increases in the electrolyte operating temperature cause a decrease in the cathode and anode diffusion layer thickness and increases the diffusion rate. Therefore, any electrolyte constituent which is dependent on diffusion to become incorporated into the deposit will be available in larger quantities for that purpose at higher temperatures. If that constituent increases deposit surface roughness, then increases in the electrolyte operating temperature will increase the deposit surface roughness.

The effect of temperature on deposit roughness is not particularly linear, thus it is more difficult to control and will often require a pragmatic approach if surface roughness is to be controlled within tight limits. The best results are obtained using frequent inspections for deposit roughness followed by small adjustments in operating parameters. The use of non depolarized anodes like electrolytic anodes and carbonyl anodes will cause the deposit to have less surface roughness than deposits made with sulfur depolarized (SD) anodes. It is felt that the sulfur depolarized anodes are a source for nickel sulfide which is known to increase the surface finish of a nickel deposit when it is present in the electrolyte as insoluble particulate. This material is particularly tenacious as it can be gelatinous, thus, will often extrude through filters.

RELATION TO IMAGING MEMBER THICKNESS

Figure 10:
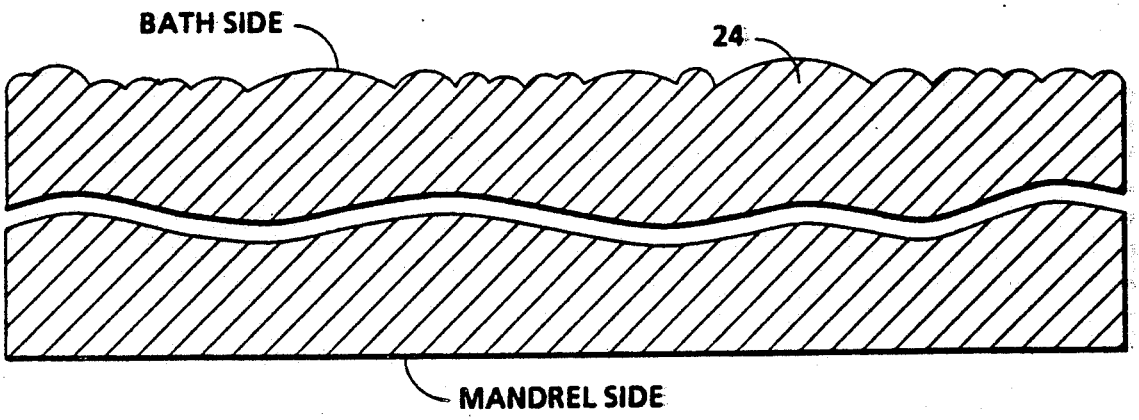
FIG. 10 is a cross-section to scale of the deposit roughness of the ground plane showing the protuberances and valleys forming the rough surface.

In order to appreciate the relationship of the ground plane surface roughness to the total imaging member thickness, a brief review of what creates the ground plane deposit roughness may prove useful. Referring to FIG. 10, the surface roughness of a 0.002 inch thick nickel deposit is seen to consist of a plurality of protuberances. The protuberances are generally oval to sphere sections which protrude from the bath side of the deposit outward to a distance (height) which is less than one quarter of the exposed diameter and can be as little as one tenth of the diameter. The shape of the indentations are opposite to the shape of the protuberances. The protuberance height (peak to valley) vary considerably at any RMS value. At 35μ inch RMS for example, the peak to center line distance is, on average, 0.000035 inches and the peak to valley distance is, again, on average, 0.000070 inches. The actual maximum peak to valley distance can be as much as 0.000315 inches.

Figure 11:
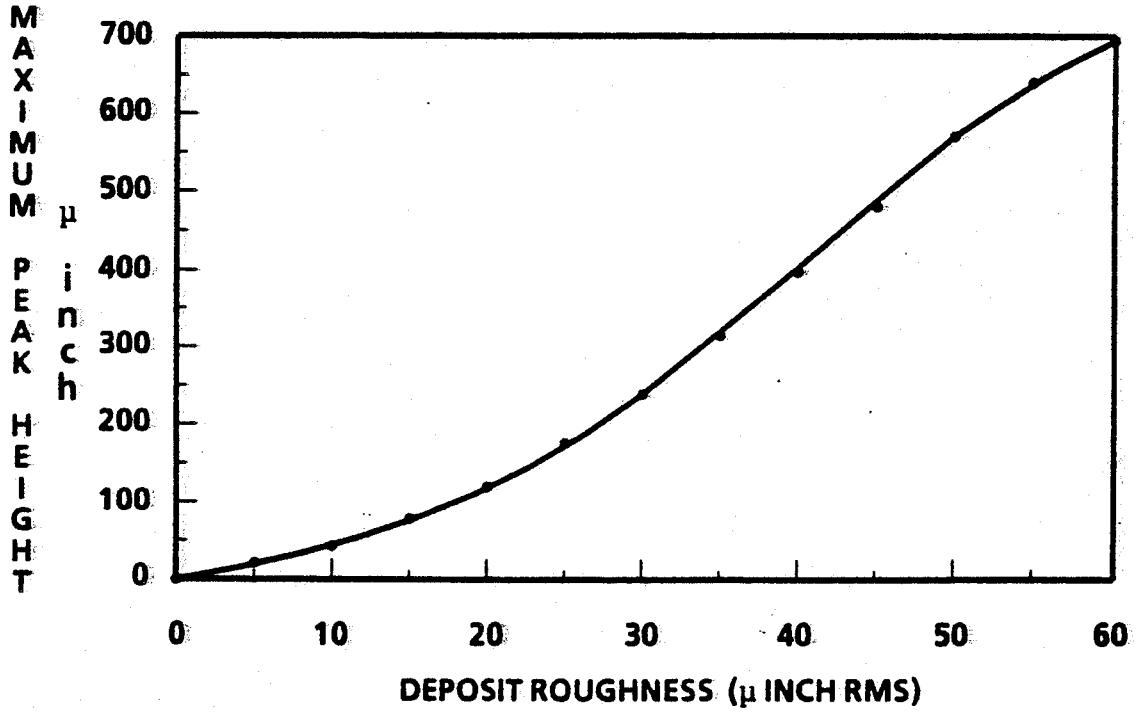
FIG. 11 is a plot showing the relationship of deposit roughness to maximum peak height of the protuberances shown in FIG. 10.

FIG. 11 shows the relationship between RMS values and maximum peak to valley distance. About 0.07% of the protuberances approach this maximum at any given RMS value. The rest of the protuberances have heights which diminish to zero with the majority having heights within 10% of twice the RMS value. The diameters of all protuberances are from 3 to 15 times their height.

It is believed that the biggest protuberances should not exceed 10% of the photoconductive thickness (or perhaps the thickness of the first active layer), but at least about 50% of the protuberances should be at about 1% of the photoconductive thickness (or perhaps the thickness of the first active layer). As an example for a 0.004 inch thickness, a surface with an RMS value between 3 and 40μ inch is acceptable. A better situation is between 3 and 20μ inch RMS, but a preferred situation is between 3 and 10μ inch RMS. At 10μ inch RMS the maximum peak to valley distance is near 0.0040 inches or 10% of the thickness. At 3μ inch RMS the maximum peak to valley distance is near 0.000008 inches but 50% of the peak to valley distances are about 0.000004 inches or about 1% of the thickness. It should be noted that the thickness of the first active layer in a typical organic Photoconductor is about 0.00003937 inches and the total thickness of all the layers is about 0.0007874 inches.

While the invention has been described with reference to the structure disclosed, it will be appreciated that numerous changes and modifications are likely to occur to those skilled in the art, and it is intended to cover all changes and modifications which fall within the true spirit and scope of the invention.

We claim:

1. A process for forming a photosensitive imaging member having at least a conductive ground plane with overlying charge transport and charge generator layers comprising the steps of forming a conductive ground plane by maintaining a continuous and stable acqueous nickel sulphamate electroforming solution adapted to form a relatively thin, ductile, seamless nickel belt having a matte-like finish, the surface of said belt having a dull appearance and a surface roughness range of 0.5 to 20.0μ inch RMS, electrolytically depositing nickel from said solution onto a support mandrel, cooling said nickel-coated mandrel effecting a parting of the nickel belt from the mandrel due to different respective coefficients of thermal expansion, overlying said nickel belt with a charge generator layer and overlying said charge generating layer with a charge transport layer.

2. The process of claim 1 wherein said surface roughness is created by forming a plurality of protuberances at the belt surface, at least 50% of the protuberances having a height about 1% of the thickness of the entire imaging member.

3. The process of claim 1 wherein said mandrel has an RMS finish of between 2 and 8μ inch RMS.

4. The process of claim 3 wherein said step of forming said nickel belt includes the step of establishing an electroforming zone comprising a non-depolarized nickel anode and cathode comprising said support mandrel, said anode and cathode being separated by said nickel sulphamate solution maintained at a temperature of about 55° to 60° C., and having a current density therein ranging from about 100 to 200 ASF.

5. The process of claim 4 further including the steps of imparting sufficient agitation to said solution to continuously expose said cathode to fresh solution; maintaining said solution within said zone at a stable equilibrium composition comprising:

| | |
|---|---|
| Total Nickel | 8 to 15.5 g/L |
| Chloride as $NiCl_2.6H_2O$ | 1 to 2.5 g/L |
| $H_3BO_3$ | 4.0 to 5.4 oz/gal |
| pH | 3.95 to 4.05 at 23° C. |
| Surface Tension | 32 to 37 dynes/cm$^2$ |
| Saccharin | 0–30 mg/L as sodium benzosulfimide dihydrate |

electrolytically removing metallic and organic impurities from said solution upon egress thereof from said electroforming zone: continuously charging to said solution about 1.3 to $1.6\times10^{-4}$ moles of a stress reducing agent per mole of nickel electrolytically deposited from said solution, passing said solution through a filtering zone to remove any solid impurities therefrom, cooling said solution sufficiently to maintain the temperature within the electroforming zone upon recycle thereto at about 130° to 160° F. at the current density in said electroforming zone; and recycling said solution to said electroforming zone.

6. The process of claim 5 wherein said saccharin is combined with a leveler.

* * * * *